US010007217B2

(12) United States Patent
Okajima

(10) Patent No.: US 10,007,217 B2
(45) Date of Patent: Jun. 26, 2018

(54) IMAGE FORMING APPARATUS HAVING A ROCKABLE INDUCTION HEATING UNIT

(71) Applicant: KYOCERA Document Solutions Inc., Osaka-shi, Osaka (JP)

(72) Inventor: Yasuhito Okajima, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days. days.

(21) Appl. No.: 15/462,689

(22) Filed: Mar. 17, 2017

(65) Prior Publication Data

US 2017/0308010 A1 Oct. 26, 2017

(30) Foreign Application Priority Data

Apr. 21, 2016 (JP) ..... 2016-085051

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/330
See application file for complete search history.

(56) References Cited

U.S. PATENT DOCUMENTS

2008/0246828 A1* 10/2008 Hirai ..... B41J 2/415 347/120
2012/0155918 A1* 6/2012 Egi ..... G03G 15/2053 399/122
2015/0030352 A1* 1/2015 Hayashi ..... G03G 15/6532 399/128
2015/0268598 A1* 9/2015 Nagata ..... G03G 15/2025 399/327
2017/0299989 A1* 10/2017 Nakano ..... G03G 15/2017

FOREIGN PATENT DOCUMENTS

JP 63311286 A 12/1988

* cited by examiner

*Primary Examiner* — Walter L Lindsay, Jr.
*Assistant Examiner* — Philip Marcus T Fadul
(74) *Attorney, Agent, or Firm* — Alleman Hall Creasman & Tuttle LLP

(57) ABSTRACT

An image forming apparatus includes an apparatus main body, a fixing unit, an induction heating unit, a positioning mechanism, and a charge adjustment portion. The fixing unit includes a first fixing member and a second fixing member that form, between them, a nip portion through which a sheet is passed. The induction heating unit is supported so as to be rockable with respect to the apparatus main body and heats the first fixing member. The positioning mechanism keeps a distance between the induction heating unit and the first fixing member constant. The charge adjustment portion is fixed to the induction heating unit in a detachable manner and electrically charges or eliminates static electricity from the first fixing member.

4 Claims, 6 Drawing Sheets

IMAGE FORMING APPARATUS HAVING A ROCKABLE INDUCTION HEATING UNIT

INCORPORATION BY REFERENCE

This application is based upon and claims the benefit of priority from the corresponding Japanese Patent Application No. 2016-085051 filed on Apr. 21, 2016, the entire contents of which are incorporated herein by reference.

BACKGROUND

The present disclosure relates to an electrophotographic image forming apparatus.

In electrophotographic image forming apparatuses, a sheet with a toner image formed thereon is passed through a nip portion between a pair of fixing members which each may be a roller or a belt, and the sheet is heated and pressed while being passed through the nip portion so that the toner image is fixed to the sheet.

In such image forming apparatuses, an offset phenomenon may occur, wherein in the offset phenomenon, a part of the toner transfers to the surface of the fixing members. There is known a fixing device in which, to prevent the offset phenomenon, a discharging brush that changes the charge amount on a surface of a heating roll, is provided at a position that faces the surface of the heating roll, and the voltage of the discharging brush is controlled based on the density of the toner image.

SUMMARY

An image forming apparatus according to an aspect of the present disclosure includes an apparatus main body, a fixing unit, an induction heating unit, a positioning mechanism, and a charge adjustment portion. The fixing unit includes a first fixing member and a second fixing member that form therebetween a nip portion through which a sheet is passed. The induction heating unit is supported so as to be rockable with respect to the apparatus main body and heats the first fixing member. The positioning mechanism keeps a distance between the induction heating unit and the first fixing member constant. The charge adjustment portion is fixed to the induction heating unit in a detachable manner and electrically charges or eliminates static electricity from the first fixing member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclusure with reference to the accompanying drawings for the understanding of the present disclosure. It should be noted that the following embodiment is an example of a specific embodiment of the present disclosure and should not limit the technical scope of the present disclosure.

[Configuration of Image Forming Apparatus]

Figure 1:
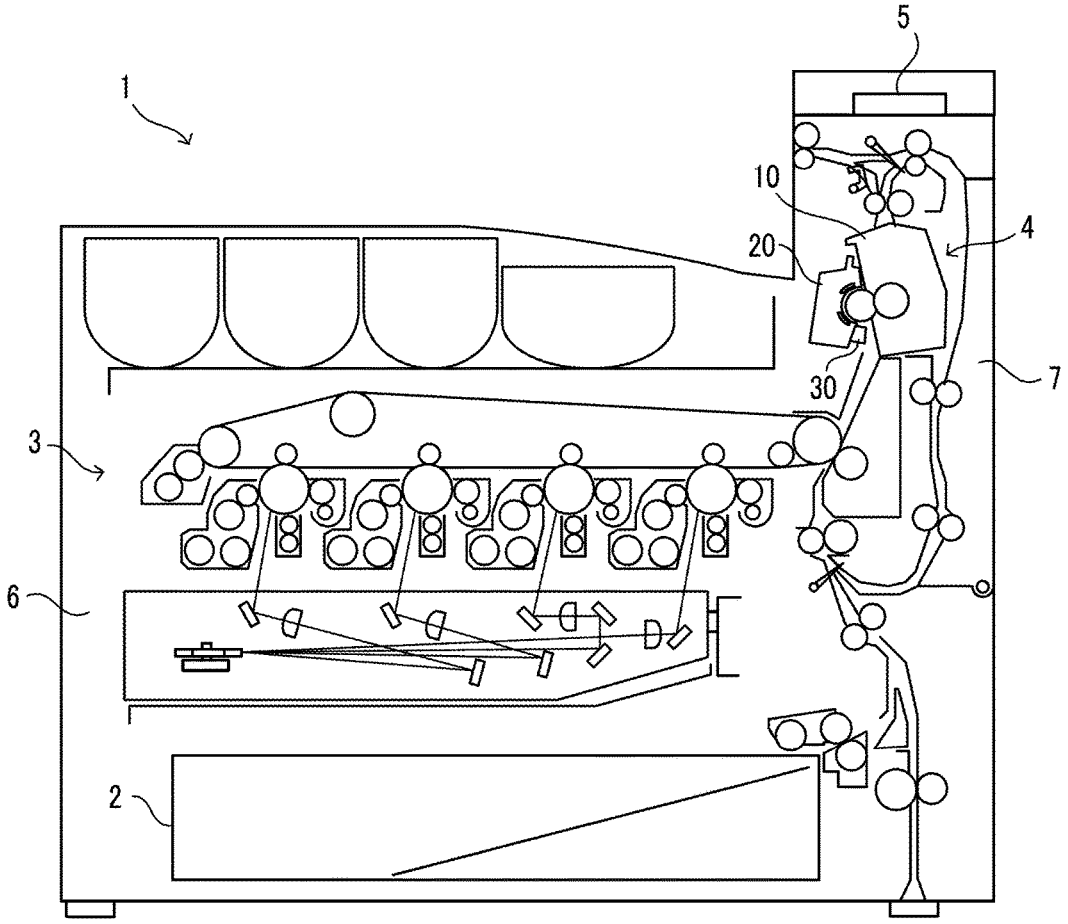
FIG. 1 is a diagram showing a configuration of an image forming apparatus according to an embodiment of the present disclosure.

First, a description is given of a configuration of an image forming apparatus 1 according to an embodiment of the present disclosure, with reference to FIG. 1. As shown in FIG. 1, the image forming apparatus 1 includes a sheet cassette 2, an image generating portion 3, a fixing portion 4, and a control portion 5. It is noted that the present disclosure is not limited to a printer, but is applicable to an arbitrary image forming apparatus such as a copier, a facsimile device, and a multifunction peripheral.

The sheet cassette 2 stores sheets such as sheets of recording paper.

The image generating portion 3 includes a photoconductor drum, a charger, an exposure device, a developing device, and a transfer device. The image generating portion 3 forms a toner image on a sheet fed from the sheet cassette 2.

The fixing portion 4 heats and presses a sheet with a toner image formed thereon such that the toner image is fixed to the sheet. A concrete configuration of the fixing portion 4 for fixing the toner image to the sheet is described below.

The control portion 5 includes control equipment such as CPU, ROM, and RAM. The CPU is a processor that executes various calculation processes. The ROM is a nonvolatile storage portion in which various information such as control programs for causing the CPU to execute various processes are stored in advance. The RAM is a volatile or nonvolatile storage portion that is used as a temporary storage memory (working area) for the various processes executed by the CPU. It is noted that the control portion 5 may include an electronic circuit that realizes the various processes.

[Configuration of Fixing Portion]

The fixing portion 4 includes a fixing unit 10, an induction heating unit 20, and a charge application portion 30 (an example of the charge adjustment portion and the contactless charger of the present disclosure).

Figure 2:
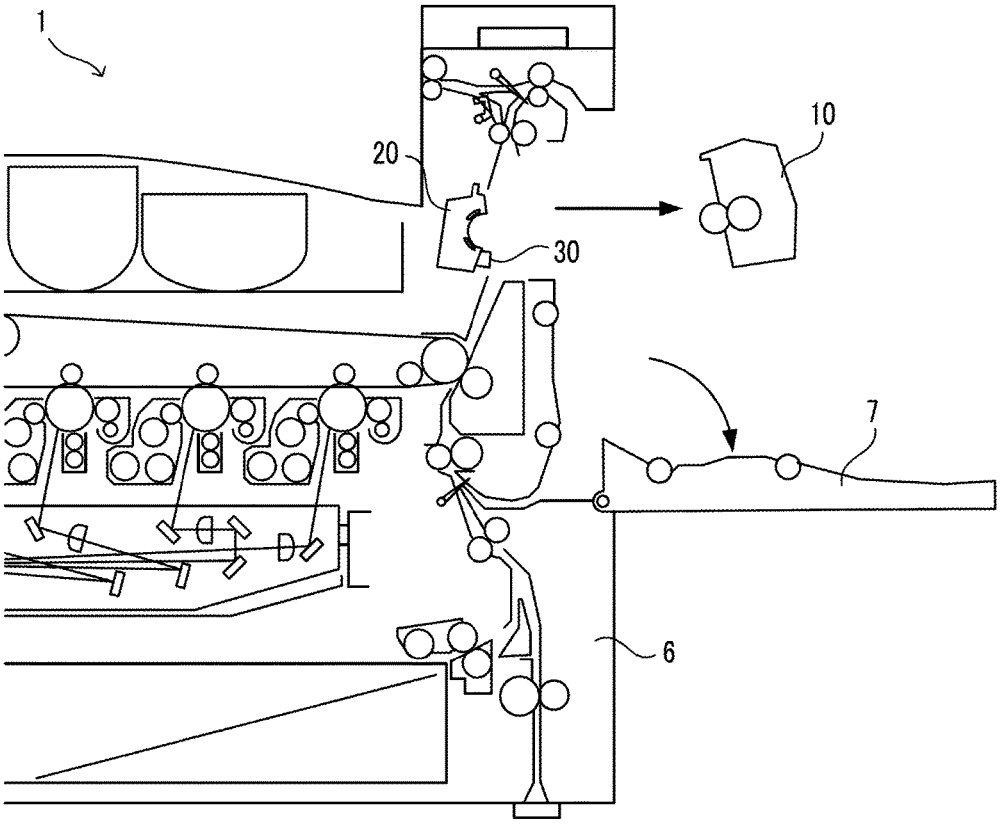
FIG. 2 is a diagram showing a configuration of the image forming apparatus according to the embodiment of the present disclosure.
Figure 3:
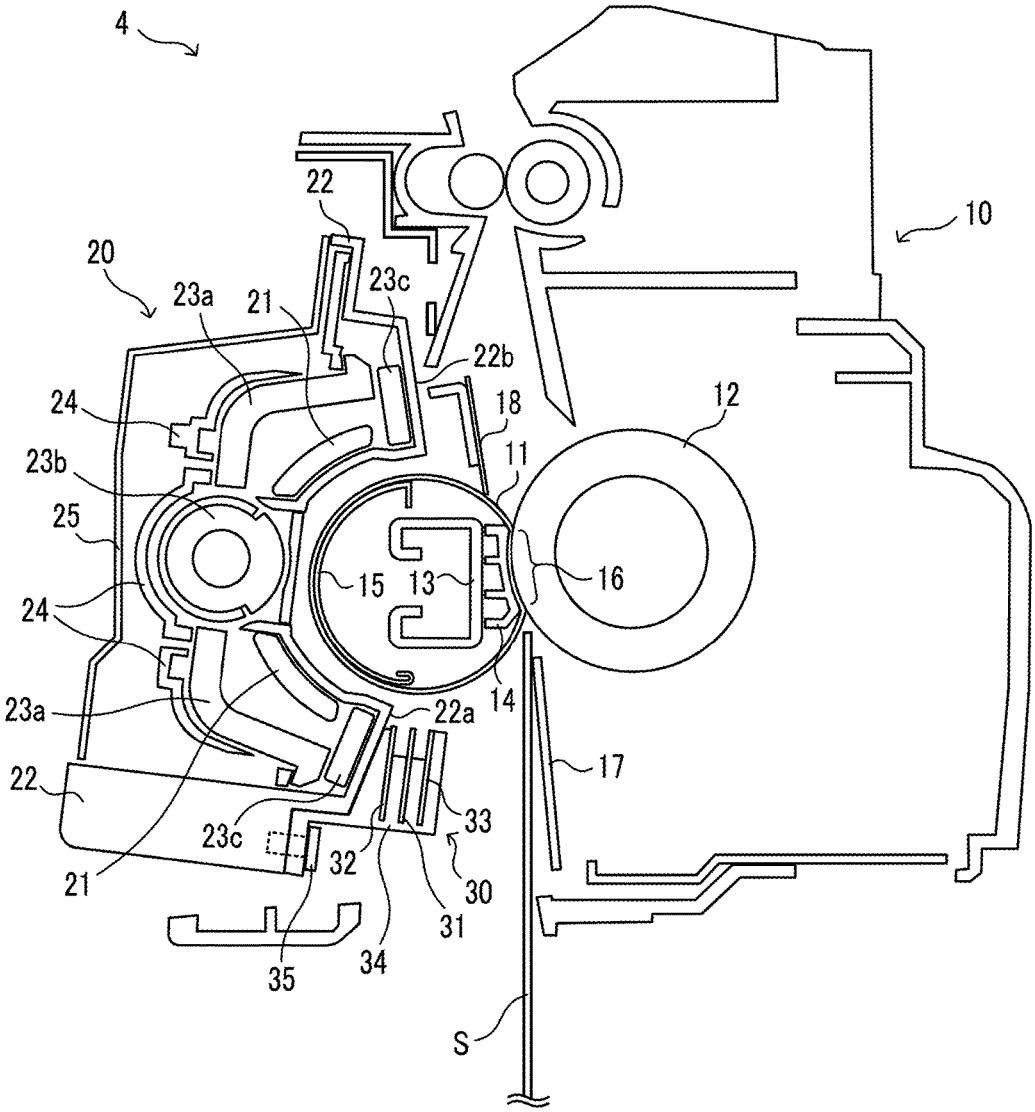
FIG. 3 is a diagram showing a configuration of a fixing portion of the image forming apparatus according to the embodiment of the present disclosure.
Figure 4:
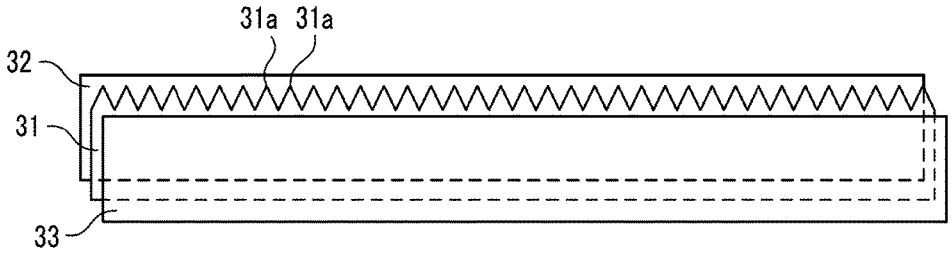
FIG. 4 is a diagram showing shapes of a discharge electrode and counter electrodes of the image forming apparatus according to the embodiment of the present disclosure.

The fixing unit 10 includes a fixing belt 11 (an example of the first fixing member of the present disclosure) and a pressure roller 12 (an example of the second fixing member of the present disclosure), wherein the fixing belt 11 and the pressure roller 12 form therebetween a nip portion 16 through which a sheet S passes (see FIG. 3). The fixing unit 10 is attached to an apparatus main body 6 of the image forming apparatus 1 in a detachable manner. Specifically, the apparatus main body 6 of the image forming apparatus 1 includes a main body cover 7 that can be opened and closed, and as shown in FIG. 2, the fixing unit 10 is attached to and detached from the apparatus main body 6 in a state where the main body cover 7 is opened.

The induction heating unit 20 is supported so as to be rockable with respect to the apparatus main body 6 and configured to heat the fixing belt 11. It is noted that in a state where the fixing unit 10 is attached to the apparatus main body 6, a distance between the induction heating unit 20 and the fixing belt 11 is kept to be constant by a positioning mechanism 40 (see FIG. 7) that is described below. Accordingly, for example, even after the fixing unit 10 is replaced with a new one, the distance between the induction heating unit 20 and the fixing belt 11 is kept to be constant and it is not necessary to finely adjust the distance between the induction heating unit 20 and the fixing belt 11. Accordingly, the induction heating unit 20 can uniformly heat the fixing belt 11.

The charge application portion 30 is fixed to the induction heating unit 20 in a detachable manner. The charge application portion 30 charges the fixing belt 11 by using the corona discharge.

Next, a more detailed description is given of the configuration of the fixing portion 4 with reference to FIG. 3.

As shown in FIG. 3, the fixing unit 10 includes the fixing belt 11, the pressure roller 12, a holding member 13, a nip forming member 14, a guide plate 15, a conveyance guide 17, and a separation plate 18, wherein the holding member 13, the nip forming member 14, and the guide plate 15 are disposed inside the fixing belt 11.

The fixing belt 11 is formed in a substantially cylindrical shape that is elongated in a width direction perpendicular to the conveyance direction of the sheet S (hereinafter, the direction is merely referred to as a "width direction"). The fixing belt 11 is supported by the holding member 13, the nip forming member 14, and the guide plate 15 in such a way as to rotate around a rotation axis that extends in the width direction. The holding member 13, the nip forming member 14, and the guide plate 15 are an example of the holding member of the present disclosure.

The fixing belt 11 is composed of a base layer, an elastic layer and a release layer, wherein the elastic layer is formed on the base layer, and the release layer is formed to cover the elastic layer. The base layer is, for example, formed by the nickel electrocasting or by performing the plating treatment or the rolling treatment on a metal such as copper. The elastic layer is formed from silicon rubber, for example. The release layer is formed from fluororesin such as PFA, for example.

The pressure roller 12 is formed in a substantially cylindrical shape that is elongated in the width direction. The pressure roller 12 is pressed against the fixing belt 11 by a pressure mechanism (not shown), and the nip portion 16 is formed between the fixing belt 11 and the pressure roller 12. The pressure roller 12 is rotatably supported by a fixing frame (not shown). The pressure roller 12 is rotationally driven by a driving mechanism (not shown).

The pressure roller 12 is composed of, for example, a cylindrical core material, an elastic layer and a release layer, wherein the elastic layer is formed on the core material, and the release layer is formed to cover the elastic layer. The core material is formed, for example, from a metal such as stainless steel or aluminum. The elastic layer is formed, for example, from silicon rubber or silicon sponge. The release layer is formed, for example, from fluororesin such as PFA.

The induction heating unit 20 includes induction coils 21, coil holding portions 22, arch cores 23*a*, a center core 23*b*, side cores 23*c*, arch core holding portions 24, and a cover portion 25, wherein the induction coils 21 are disposed in an arc shape along an outer circumference of the fixing belt 11, the coil holding portions 22 hold the induction coils 21, and the arch core holding portions 24 hold the arch cores 23*a*.

When toner T (see FIG. 5) is fixed to the sheet S, a high-frequency current is applied to the induction coils 21. This causes the induction coils 21 to generate a magnetic field. An eddy current is then generated in the fixing belt 11 by the act of the magnetic field, and the fixing belt 11 is heated. That is, the fixing belt 11 is heated by the induction coils 21. In addition, the guide plate 15 is heated by the act of the magnetic field, and the fixing belt 11 is heated also by the guide plate 15.

In addition, when the toner T is fixed to the sheet S, the pressure roller 12 is rotationally driven by a driving mechanism (not shown). This causes the fixing belt 11 that is pressed against the pressure roller 12, to be rotated following the rotation of the pressure roller 12. The fixing belt 11 rotated in this way slides over the nip forming member 14. In this situation, when the sheet S enters the nip portion 16, the heated fixing belt 11 contacts the unfixed toner T on the sheet S. This causes the toner T to be fused, pressed, and fixed to the sheet S. After it passes through the nip portion 16, the sheet S is separated from the fixing belt 11 by the separation plate 18, and is discharged to outside the fixing unit 10.

Meanwhile, in the fixing portion 4 having the above-described configuration, an offset phenomenon may occur in which a part of the toner T transfers to the surface of the fixing belt 11. It is considered that, to prevent the offset phenomenon, a charge adjustment portion such as a discharging brush that changes the charge amount on the surface of the fixing belt 11, may be provided at a position that faces the surface of the fixing belt 11. In this case, unevenness of the charge amount on the surface of the fixing belt 11 may occur if the distance between the surface of the fixing belt 11 and the charge adjustment portion is not uniform along the axial direction. According to the present embodiment, the charge application portion 30 is fixed to the induction heating unit 20, and thus the charge application portion 30 can be set easily at an appropriate position.

In the present embodiment, it is supposed that unfixed toner T on the sheet S is positively charged. On the other hand, fluororesin such as PFA used in the release layer of the fixing belt 11 is likely to be negatively charged. Thus in this state, the offset phenomenon is likely to occur in which the positively charged toner T transfers to the negatively charged surface of the fixing belt 11. In view of this, in the present embodiment, the charge application portion 30 applies an electric charge of the same polarity as that of the toner T on the sheet S (namely, the positive polarity) to the surface of the fixing belt 11. With this configuration, since the surface of the fixing belt 11 is charged to the same polarity as that of the toner T, the transfer of the toner T to the surface of the fixing belt 11 is effectively restricted.

[Configuration of Charge Application Portion]

The charge application portion 30 includes a discharge electrode 31, a pair of counter electrodes 32 and 33, an electrode holding portion 34, and a bolt 35. The counter electrodes 32 and 33 face each other across the discharge electrode 31. The electrode holding portion 34 holds these electrodes. The bolt 35 fixes the electrode holding portion 34 to the coil holding portions 22 of the induction heating unit 20 in a dechable manner.

The discharge electrode 31 and the counter electrodes 32 and 33 are disposed apart from the outer circumferential surface of the fixing belt 11. As shown in FIG. 3, the discharge electrode 31 is a plate-like electrode made of stainless steel that is thin in plate thickness (approximately 0.1 mm), wherein saw teeth are formed along the width direction on its edge portion facing the fixing belt 11. The counter electrodes 32 and 33 are plate-like electrodes made of stainless steel, and are disposed apart by a predetermined distance from pointed end portions 31*a* of the teeth formed on the discharge electrode 31.

Figure 5:
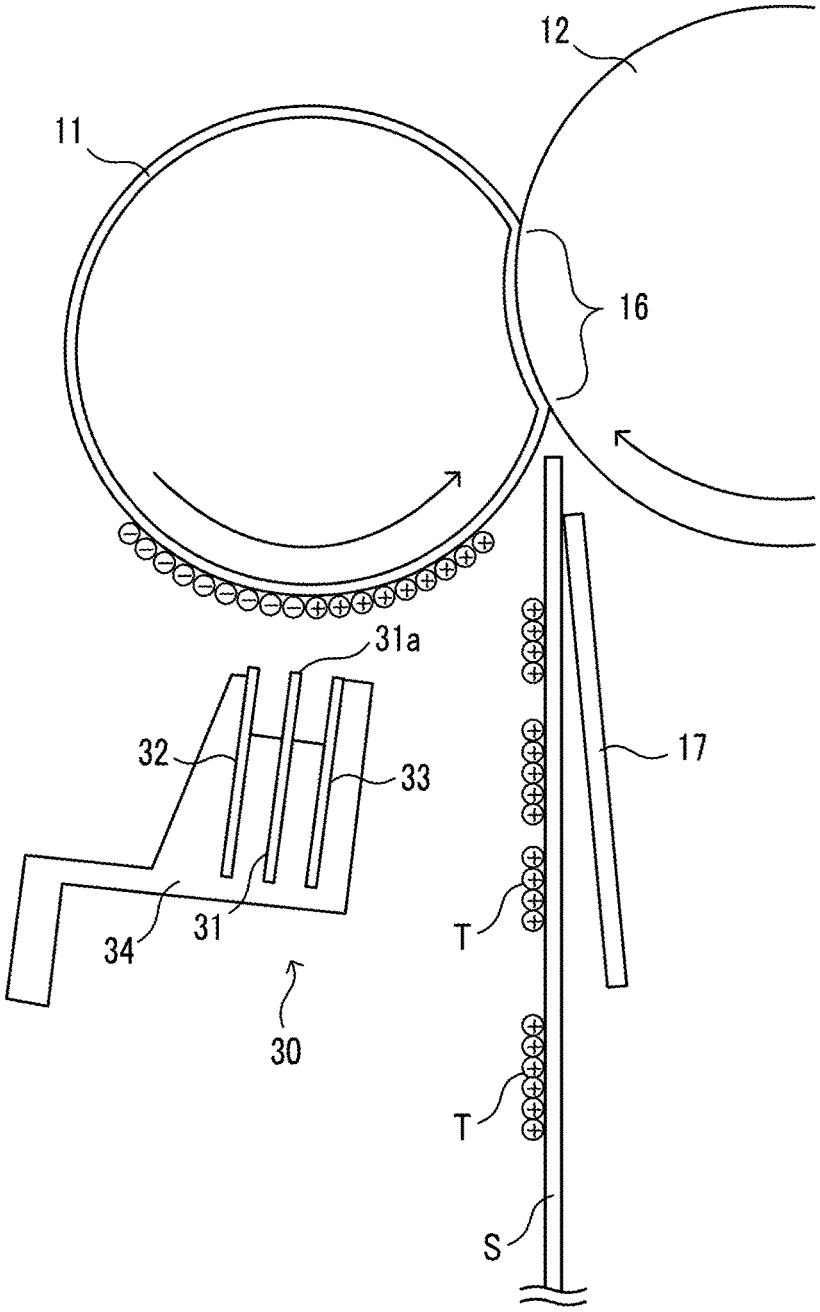
FIG. 5 is a diagram showing an example of a fixing belt and a toner image that are in a charged state in the image forming apparatus according to the embodiment of the present disclosure.

A high voltage power source (not shown) is connected to the discharge electrode 31, and the counter electrodes 32 and 33 are grounded. When the fixing portion 4 performs a fixing operation, a high voltage is applied to the discharge electrode 31 under the control of the control portion 5. When the high voltage is applied to the discharge electrode 31, a corona discharge is continuously generated between the pointed end portions 31*a* of the teeth formed on the discharge electrode 31 and the counter electrodes 32 and 33. Positive ions generated by the corona discharge move away from the pointed end portions 31*a* of the discharge electrode 31, and the surface of the fixing belt 11 is positively charged by a part of those positive ions. As a result, as shown in FIG. 5, the surface of the fixing belt 11 that had been negatively charged is positively charged by the positive ions coming from the charge application portion 30, and while keeping that state, the surface of the fixing belt 11 moves toward the nip portion 16. This allows the toner T on the sheet S and the surface of the fixing belt 11 to have the same polarity in the nip portion 16, which makes it possible to restrict the transfer of the toner T to the surface of the fixing belt 11.

[Positioning Mechanism]

Figure 6:
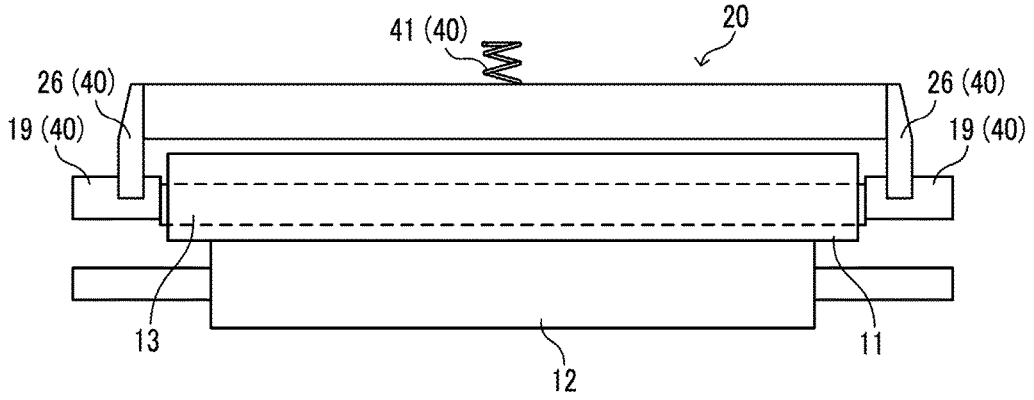
FIG. 6 is a diagram showing a configuration of a positioning mechanism of the image forming apparatus according to the embodiment of the present disclosure.
Figure 7:
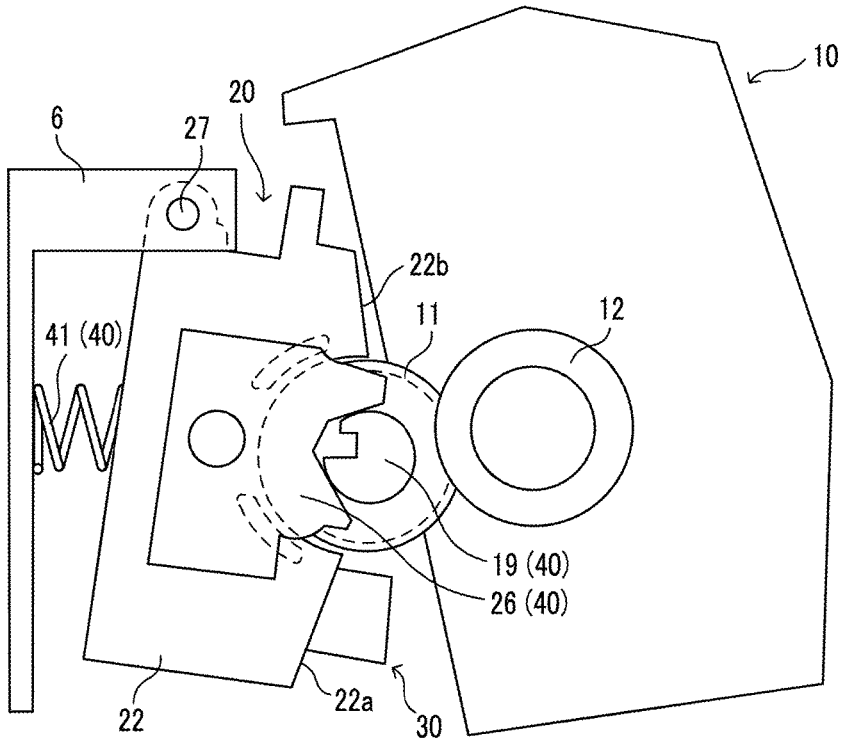
FIG. 7 is a diagram showing a configuration of the positioning mechanism of the image forming apparatus according to the embodiment of the present disclosure.

Next, a description is given of the positioning mechanism 40 that keeps the distance between the induction heating unit 20 and the fixing belt 11 constant, with reference to FIG. 6 and FIG. 7.

FIG. 6 is a diagram showing the induction heating unit 20 and the fixing belt 11 viewed from above. FIG. 7 is a diagram showing the induction heating unit 20 and the fixing belt 11 viewed from a side along the width direction.

In the present embodiment, first positioning members 26, second positioning members 19, and a compression spring 41 are provided as the positioning mechanism 40. The first positioning member 26 are respectively fixed to opposite ends of the induction heating unit 20 in the width direction. The second positioning members 19 are respectively fixed to opposite ends of the holding member 13 in the width direction, the holding member 13 holding the fixing belt 11. One end of the compression spring 41 is fixed to the apparatus main body 6, and the other is fixed to the induction heating unit 20.

The induction heating unit 20 is rockably supported by the apparatus main body 6. Specifically, as shown in FIG. 7, the induction heating unit 20 is supported so as to be pivotable around a support point 27 with respect to the apparatus main body 6, and is biased toward the fixing unit 10 by the compression spring 41.

The second positioning members 19 has an approximately cylindrical shape, and is configured such that its central axis matches the rotation axis of the fixing belt 11.

The induction heating unit 20 is biased toward the fixing unit 10 by the compression spring 41. Thus, when the fixing unit 10 is attached to a predetermined position of the apparatus main body 6, as shown in FIG. 7, the first positioning members 26 and the second positioning members 19 are pressed against each other by the compression spring 41, and the positional relationship between the first positioning members 26 and the second positioning members 19 is fixed. As a result, a distance between the fixing belt 11 and the induction coils 21 of the induction heating unit 20 becomes uniform along the width direction. This makes it possible for the induction coils 21 to heat the fixing belt 11 uniformly.

In the present embodiment, the charge application portion 30 is fixed to the coil holding portions 22 of the induction heating unit 20. Since the positional relationship between the first positioning members 26 and the coil holding portions 22 is fixed, the distance between the fixing belt 11 and the charge application portion 30 is also made uniform along the width direction by the positioning mechanism 40. In particular, when a contactless charger such as the charge application portion 30 is used, originally, it is not easy to keep the distance of it from the fixing belt 11 constant along the width direction. However, according to the present embodiment, even a contactless charger such as the charge application portion 30 is used, it is possible to easily keep the distance of it from the fixing belt 11 constant along the width direction.

It is noted that the image forming apparatus 1 includes an adjustment mechanism configured to adjust an inclination of the fixing unit 10 so that the conveyance direction of the sheet S by the nip portion 16 can be adjusted appropriately. For example, the inclination of the fixing unit 10 may be adjusted by changing the position (height) of the guide member that is provided in the apparatus main body 6 to support the fixing unit 10. In the present embodiment, the charge application portion 30 is attached to the induction heating unit 20. Accordingly, even if the inclination of the fixing unit 10 is changed by the adjustment mechanism, the distance between the fixing belt 11 and the induction heating unit 20 is kept constant by the positioning mechanism 40, and thus the distance between the fixing belt 11 and the charge application portion 30 is also kept constant. As a result, according to the present embodiment, it is possible to easily set the charge application portion 30 at an appropriate position.

In addition, the charge application portion 30 easily becomes dirty due to scattered paper dust and toner, and thus is replaced with a new one as necessary. According to the present embodiment, as shown in FIG. 2, the attachment position of the charge application portion 30 to the induction heating unit 20 is exposed to outside in a state where the fixing unit 10 is detached from the apparatus main body 6. Thus, according to the present embodiment, the charge application portion 30 can be easily replaced.

In addition, in the present embodiment, the attachment position of the charge application portion 30 to the induction heating unit 20 is a side surface 22*a* of the induction heating unit 20 that is located on the downstream side in the moving direction of the outer circumferential surface of the fixing belt 11 disposed to face the induction heating unit 20 (see FIG. 3 and FIG. 7). As a result, as shown in FIG. 5, the surface of the fixing belt 11 is positively charged immediately before it reaches the nip portion 16. Accordingly, the surface of the fixing belt 11 reaches the nip portion 16 while it is in the positively charged state in a more reliable manner than a case where the charge application portion 30 is attached to a side surface 22*b* that is on an upper portion of the induction heating unit 20 as shown in FIG. 3.

[Modification]

It is noted that according to the present embodiment, it is supposed that the toner T on the sheet S is positively charged. However, in a case where the toner T on the sheet S is negatively charged, a negative voltage may be applied to the discharge electrode 31 of the charge application portion 30 so that the surface of the fixing belt 11 is negatively charged.

In addition, in the present embodiment, a plate-like electrode made of stainless steel on which saw teeth are formed is used as the discharge electrode 31 of the charge application portion 30. However, the present disclosure is not limited to this, but, for example, a tungsten wire may be used as the discharge electrode 31.

In addition, in the present embodiment, the charge application portion 30 is provided as a contactless charger that electrically charges the fixing belt 11. However, the present disclosure is not limited to this. For example, the present disclosure can be applied to a case of having a contactless static eliminator (an example of the charge adjustment portion and the contactless static eliminator of the present disclosure), such as a discharging brush, that eliminates static electricity from the fixing belt 11. In this case, the static eliminator is attached to the induction heating unit 20. This allows a distance between the fixing belt 11 and the static eliminator to become uniform along the width direction, and makes it possible to uniformly eliminate static electricity from the fixing belt 11.

In addition, in the present embodiment, the fixing belt 11 is heated by the induction heating unit 20. However, the present disclosure is not limited to this configuration, but, for example, is applicable to a configuration where the fixing roller is heated by the induction heating unit 20.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body;

a fixing unit including a first fixing member and a second fixing member that form therebetween a nip portion through which a sheet is passed;

an induction heating unit supported so as to be rockable with respect to the apparatus main body and configured to heat the first fixing member;

a positioning mechanism configured to keep a distance between the induction heating unit and the first fixing member constant; and a contactless charge application portion fixed to the induction heating unit in a detachable manner, including a discharge electrode and a counter electrode, and configured to apply an electric charge to the first fixing member.

2. The image forming apparatus according to claim 1, wherein the positioning mechanism includes:

first positioning members respectively provided on opposite ends of the induction heating unit in a width direction that is perpendicular to a conveyance direction of the sheet;

second positioning members respectively provided on opposite ends of a holding member in the width direction and configured to abut on the first positioning members respectively, the holding member holding the first fixing member; and a compression spring configured to cause the first positioning members and the second positioning members to be pressed against each other.

3. The image forming apparatus according to claim 1, wherein the fixing unit is attached to the apparatus main body in a detachable manner, and an attachment position of the charge application portion to the induction heating unit is exposed to outside in a state where the fixing unit is detached from the apparatus main body.

4. The image forming apparatus according to claim 1, wherein an attachment position of the charge application portion to the induction heating unit is a side surface of the induction heating unit that is located on a downstream side in a moving direction of an outer circumferential surface of the first fixing member disposed to face the induction heating unit.

* * * * *